United States Patent [19]

Stephanoff

[11] 4,131,239

[45] Dec. 26, 1978

[54] FLUID ENERGY MILL FOR LARGE PARTICULATE MATERIALS

[75] Inventor: Nicholas N. Stephanoff, Haverford, Pa.

[73] Assignee: Energy Processing and Equipment Co., Bala Cynwyd, Pa.

[21] Appl. No.: 805,878

[22] Filed: Jun. 13, 1977

[51] Int. Cl.[2] ..... B02C 19/06

[52] U.S. Cl. ..... 241/39; 241/5

[58] Field of Search ..... 241/5, 39

[56] References Cited

U.S. PATENT DOCUMENTS

| | | | |
|---|---|---|---|
| 2,237,091 | 4/1941 | Stephanoff | 241/5 |
| 2,325,080 | 7/1943 | Stephanoff | 241/5 |
| 2,590,219 | 3/1952 | Stephanoff | 241/5 |
| 3,252,663 | 5/1966 | Kidwell | 241/39 |
| 3,467,317 | 9/1969 | Stephanoff | 241/39 |
| 3,491,953 | 1/1970 | Stephanoff | 241/39 |
| 3,648,936 | 3/1972 | Stephanoff | 241/5 |

*Primary Examiner*—Granville Y. Custer, Jr.
*Attorney, Agent, or Firm*—Arthur A. Jacobs

[57] ABSTRACT

A "fluid energy" mill comprising a generally arcuate or torroidal housing in which a centrifugally-whirled circulating stream of high pressure gaseous fluid is used as a grinding medium for particulate material having relatively large particle sizes; the mill having a by-pass duct leading from a classification zone where lighter particles are separated from heavier particles to a grinding chamber; the by-pass duct acting as a passage for the heavier particles back to the grinding chamber where they are mixed with newly entering particulate material fed to the grinding chamber; and a passage in the median portion of the by-pass duct connecting with a separator for removing the heaviest particles from the by-pass duct.

5 Claims, 5 Drawing Figures

FIG. 1
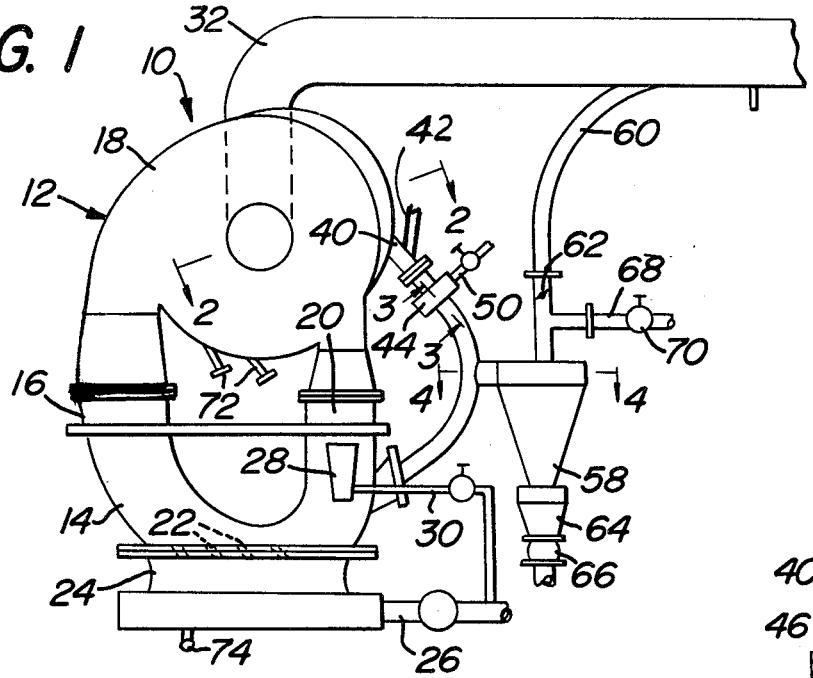
FIG. 3
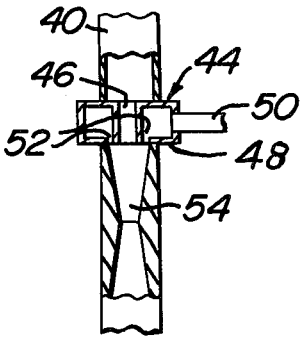
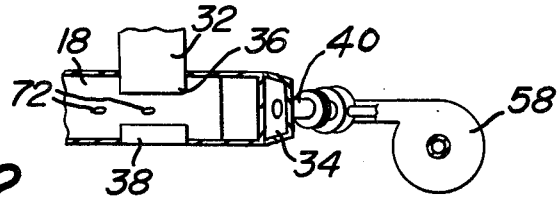
FIG. 2
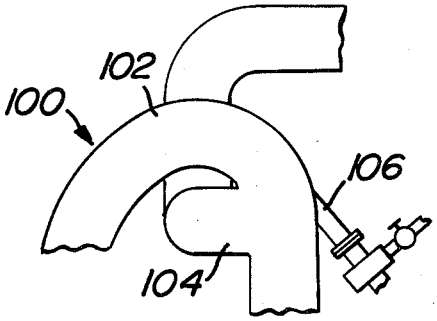
FIG. 5
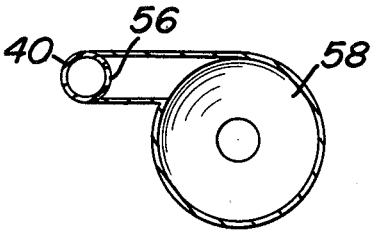
FIG. 4

FLUID ENERGY MILL FOR LARGE PARTICULATE MATERIALS

This invention relates to "fluid energy" type grinding mills utilizing whirling gaseous fluids as the grinding medium, and it particularly relates to the use of such mills for the grinding of particulate material comprising particles of relatively large size.

Fluid energy mills, as such, are now well-known and are in extensive use. Many of these mills comprise a vertically elongated generally arcuate construction including straight, elongated upstack and downstack sections connected at top and bottom by arcuate elbow sections. Nozzles lead into the lower elbow portion from a source of gaseous fluid under pressure. These nozzles are tangentially directed relative to the path of flow through the lower elbow, or inlet, section, and all or some of them may be so positioned that the fluid jets issuing therefrom intersect each other, whereby a greater grinding or pulverizing effect is obtained. The inlet section is also provided with a feed inlet for the solid pulverulent material being ground or otherwise treated; this feed inlet being so arranged that the feed path intersects the fluid jet streams, so that the particles are entrained thereby and are not only ground or otherwise treated by action of the fluid, but are also circulated through the mill by the tangentially directed fluid stream.

During the aforesaid type of action, the centrifugal force of the circulating fluid and particles carries these particles into a classification zone where they are centrifugally separated into smaller and larger particles, the smaller, lighter particles tending to remain on the inner periphery of the circulating stream while the larger, heavier particles tend to remain on the outer periphery. This centrifugal separation is utilized to remove the lighter particles from the mill while circulating the heavier particles for an additional pass through the mill to effect further pulverization or other treatment thereof. This is achieved by providing an exhaust duct on the inner periphery of the mill adjacent the entrance to the return stack. As the centrifugal action carries the particles past this exhaust duct, the lighter particles on the inner peripheral portion of the stream flow through the exhaust duct and are removed from the mill, while the heavier particles on the outer peripheral portion of the stream pass back into the inlet section and, after being intermixed with additional raw material, are again subjected to the pulverizing action of the fluid jet streams.

Although the aforesaid type of mills have long been successfully used for particulate material having a relatively small initial particle size, as for example, about 300 to 400 mesh, they have never, heretofore, been satisfactorily utilized for the grinding of much larger particles, for example, in the range of an eighth to a quarter inch. All prior attempts to do so have resulted in rapid clogging of the mill as well as rapid wear.

The present energy situation has largely focused on the use of coal as an alternative source of energy to oil and gas. One problem in the use of coal, however, is its transportation from one area of the country to another. It has been proposed to pulverize the coal into fine particles, fluidize it, and transport it through pipes in a similar manner to oil and gas. It has, heretofore, however, not been possible to satisfactorily pulverize the coal in a commercially and economically feasible manner. Another problem in the use of coal is the ecological problem of ash and sulfur deposits in the atmosphere. It has not, heretofore, been possible to satisfactorily remove the ash and sulfur content of the coal without undue trouble and expense of such a magnitude as to make the use of coal commercially infeasible.

It is an object of the present invention to overcome the aforementioned difficulties by providing a "fluid energy" type grinding mill system, and a process of utilizing it, which satisfactorily and economically grinds large particles, such as crushed coal, without clogging or damaging the mill.

Another object of the present invention is to provide a mill system of the aforesaid type, and a process of utilizing it, which not only satisfactorily grinds coal and the like in an economical manner but which simultaneously removes a substantial proportion of impurities, such as ash and sulfur, from the ground product.

Other objects and many of the attendant advantages of this invention will be readily appreciated as the same becomes better understood by reference to the following description when read in conjunction with the accompanying drawings wherein:

FIG. 1 is a side elevational view of a grinding mill system embodying the present invention.

FIG. 2 is a cross-sectional view taken on line 2—2 of FIG. 1.

FIG. 3 is a cross-sectional view taken on line 3—3 of FIG. 1.

FIG. 4 is a cross-sectional view taken on line 4—4 of FIG. 1.

FIG. 5 is a side elevational view of a modified form of mill used in the system.

Referring in greater detail to the drawings wherein similar reference characters refer to similar parts, there is shown in FIG. 1 a system, generally designated 10, comprising a "fluid energy" type mill 12, preferably of the "tractrix" type disclosed in U.S. Pat. No. 3,648,936, dated Mar. 14, 1972, and incorporated herein by reference.

The mill 12 includes an inlet or grinding chamber 14, an upstack 16, a classifier section 18, and a downstack 20. Gaseous fluid inlet nozzles 22 extend from a gaseous fluid manifold 24 into the inlet section 14, this manifold being connected to a source of gaseous fluid under pressure (not shown) through a duct 26. A feed inlet 28 is provided at the lower end of the downstack 20 adjacent to the inlet chamber 14, this feed inlet being of the same type as disclosed in the aforesaid patent and having fluid conduit means 30 for passing gaseous fluid into the feed inlet for accelerating the fed material into the mill.

The classifier section 18 is provided at its center with an exhaust duct 32 and is so shaped that the portion of its outer periphery which is downstream (or adjacent the downstack) is tapered inwardly at 34, as best shown in FIG. 2. The outlet duct 32 extends somewhat into the section 18, as a counterbalance to the flow of circulating gaseous fluid in that section of the mill. An insert 38 is provided in order to concentrate the flow of particles at the area of the exhaust duct so as to increase the outflow of the smaller particles in that area through the exhaust duct. The smaller particles are in that area because the centrifugal force within the classification section stratifies the smaller, lighter particles and the larger, heavier particles into generally two separate laminer zones, the lighter particles being in the inner peripheral zone and the heavier particles being in the outer peripheral zone.

The heavier particles in the outer peripheral zone are, themselves, concentrated at the downstream portion of the centrifugal path by the tapered section 34 previously described.

At the tapered peripheral portion 34 of the section 18 is an inlet into a by-pass duct 40. This duct 40 extends around to the lower portion of the downstack 20 of the mill, adjacent the feed inlet 28. The heavier particles on the outer periphery, which are concentrated at 34, pass into by-pass duct 40, and their movement through this by-pass duct is aided by the gaseous fluid entering the by-pass duct through a conduit 42 which is connected to a source of such gaseous fluid (not shown).

Immediately below the conduit 42 is an orifice plate 44, best seen in FIG. 3, which has a central passage 46 surrounded by a jacket 48 connected to a source of gaseous fluid under pressure by a conduit 50. The jacket 48 has a plurality of annularly-arranged nozzles 52 to project the gaseous fluid downstream into the by-pass duct 40. This gaseous fluid, moving through a Venturi passage 54 in the duct 40, acts to accelerate the flow of the particles through the duct 40 back into the mill.

Below the orifice plate 44 is a slot 56, best seen in FIG. 4, which may be made adjustable if desired, and this slot 56 is in communication with a separator 58. This separator is preferably a centrifugal type dust collector, as shown, but may, if desired, also be of the quiescent or pressurized type of separator. The slot 56 is of high importance since this provides a passage into the separator for the particles of greatest size and weight which are on the outer periphery (or right side zone as seen in FIG. 1) of the by-pass duct 40. Since, when grinding materials such as coal, these heavier particles are primarily ash and pyrites, they constitute undesirable impurities which are required to be withdrawn from the mill, while the coal particles are returned through the duct 40 to the mill for further grinding.

The separator 58, which may be referred to as a "rejector" (rejector of impurities) is here shown as a centrifugal collector which separates the large particles from the gaseous fluid and any smaller particles remaining therein.

The gaseous fluid and smaller particles, which, in the case of coal, are generally fine coal particles that may have adhered to the impurities or been whirled along with them into the separator pass upwardly through a duct 60 having a butterfly valve 62, said duct 60 being in communication with the exhaust duct 32; while the heavier particles, or impurities, pass down into a receiver 64 from where they are discharged through a rotary valve 66.

In some instances, it may be desirable to substantially prevent any flow of fines through the slot 56. In such instances, a valved duct 68 is connected to the separator and to a source of low pressure gas. A valve 70 is used to selectively shut off, open or meter the gaseous fluid in any desired amount. This provides a gentle blow-back through the slot 56 which is sufficient to prevent passage of the fines but which is not sufficient to prevent passage to the heavier particles.

The mill 10 may also include, as an optional feature, a plurality of angular nozzles 72 connected to a source of gaseous fluid under pressure. The pressurized fluid from these nozzles may be used to increase the rotational velocity of the particles around the classifier section 18. These nozzles are similar to those disclosed in the aforesaid U.S. Pat. No. 3,648,936. A drain pipe 74 leads from the manifold 24 to remove any moisture that may be present therein due to any condensation of the gaseous fluid.

Although the orifice plate 44 has been disclosed as being situated above (or upstream) from the slot 56 and separator 58, and although this position is generally preferable because it prevents any creation of suction due to possible partial vacuum if the orifice plate were situated downstream from the slot, nevertheless it is possible to position it downstream therefrom, especially if a situation should be present where a slight suction would be desirable.

The above-described device is of great advantage in the pulverization of coal into fine particles, with the simultaneous removal of a substantial proportion of the impurities, such as the ash and sulfur content of the raw coal. In this respect, in bituminous coal, for example, the ash content averages about 10 to 12% and may go as high as 20% of the total, while the sulfur content, usually in the form of particles of pyrites, averages about 2 to 3% and may go as high as about 7.5%. Since the ash and pyrities particles are less subject to pulverization in the mill, these impurities are substantially removed from the outer peripheral path of the whirling stream in the manner described above.

In FIG. 5 there is shown a modified form of the mill that is disclosed in FIG. 1, this mill, generally designated 100, being similar to that shown in FIG. 1 in every respect, but, instead of a circular classification chamber, such as shown at 18 in FIG. 1, the mill has an arcuate upper portion 102 to serve as the classification chamber, and the exhaust port 104 is provided at the inner periphery of the mill, at the junction of the classification chamber and the downstack, just below the inlet into the by-pass duct 106.

The invention claimed is:

1. A grinding mill comprising a generally annular housing including an inlet grinding chamber at one portion of said housing, a classification chamber at the opposite portion of said housing, an upstack connecting one end of said inlet chamber to one end of said classification chamber, an exhaust port in communication with the inner periphery of said classification chamber, a downstack in opposed relation to said upstack and connecting the opposite end of said inlet chamber to the opposite end of said classification chamber, a feed inlet at the junction of said downstack and inlet chamber, said feed inlet leading into said inlet chamber, a plurality if tangentially-arranged gaseous fluid nozzles leading into said inlet chamber from a source of gaseous fluid under pressure, a by-pass duct extending from the outer periphery of that portion of said classification chamber which is adjacent to said downstack to that portion of said inlet chamber which is adjacent to said downstack and to said feed inlet, reject means in said by-pass duct for removing the heavier particles passing through said by-pass duct while the lighter particles continue to move through said by-pass duct into said inlet chamber, said reject means comprising a slot in the outer peripheral wall of said by-pass duct, said slot being in communication with a separator for separating heavier rejected particles from lighter rejected particles and gaseous fluid, and blow-back means for passing gaseous fluid under low pressure through said slot into said by-pass duct.

2. The mill of claim 1 wherein said separator is a centrifugal separator.

3. The mill of claim 1 wherein duct means are provided to connect one portion of said separator with said exhaust port of said classification chamber to direct the lighter rejected particles and gaseous fluid into mixture with the particles and fluid passing through said exhaust port.

4. A grinding mill comprising a generally annular housing including an inlet grinding chamber at one portion of said housing, a classification chamber at the opposite portion of said housing, an upstack connecting one end of said inlet chamber to one end of said classification chamber, an exhaust port in communication with the inner periphery of said classification chamber, a downstack in opposed relation to said upstack and connecting the opposite end of said inlet chamber to the opposite end of said classification chamber, a feed inlet at the junction of said downstack and inlet chamber, said feed inlet leading into said inlet chamber, a plurality of tangentially-arranged gaseous fluid nozzles leading into said inlet chamber from a source of gaseous fluid under pressure, a by-pass duct extending from the outer periphery of that portion of said classification chamber which is adjacent to said downstack to that portion of said inlet chamber which is adjacent to said downstack and to said feed inlet, reject means in said by-pass duct for removing the heavier particles passing through said by-pass duct while the lighter particles continue to move through said by-pass duct into said inlet chamber, and an orifice plate positioned in said by-pass duct, said orifice plate being in fluid connection with a source of fluid under pressure and having nozzles directed downstream within said by-pass duct, and a Venturi passage downstream from said orifice plate within said by-pass duct.

5. The mill of claim 4 wherein said orifice plate and Venturi passage are upstream of said reject means between said classification chamber and said reject means.

* * * * *